US005772466A

United States Patent [19]

Morin et al.

[11] Patent Number: 5,772,466

[45] Date of Patent: Jun. 30, 1998

[54] RECEPTACLE CONNECTOR DETECTING MATING WITH DIFFERENT PLUGS

[75] Inventors: Scott Frederick Morin, San Jose; Jonathan Earl Buck, Santa Clara; Brian Patrick Costello, Redwood City, all of Calif.

[73] Assignee: The Whitaker Corporation, Wilmington, Del.

[21] Appl. No.: 720,495

[22] Filed: Sep. 30, 1996

[51] Int. Cl.[6] ..... H01R 3/00

[52] U.S. Cl. ..... 439/489

[58] Field of Search ..... 439/488, 489, 439/607, 608, 609, 610, 188

[56] References Cited

U.S. PATENT DOCUMENTS

| | | | |
|---|---|---|---|
| 4,070,557 | 1/1978 | Ostapovitch | 200/51.1 |
| 4,224,485 | 9/1980 | Krumreich | 200/51.1 |
| 4,438,303 | 3/1984 | Astier | 200/51.1 |
| 4,552,423 | 11/1985 | Swengel, Jr. | 439/570 |
| 4,671,599 | 6/1987 | Olsson | 439/188 |
| 4,699,443 | 10/1987 | Goodrich et al. | 439/188 |
| 4,744,769 | 5/1988 | Grabbe et al. | 439/284 |
| 4,878,853 | 11/1989 | Yamade et al. | 439/489 |
| 5,112,238 | 5/1992 | Cizin | 439/188 |
| 5,244,402 | 9/1993 | Pasterchick, Jr. et al. | 439/217 |
| 5,387,135 | 2/1995 | Shen et al. | 439/676 |
| 5,501,608 | 3/1996 | Scheer et al. | 439/218 |

*Primary Examiner*—Gary F. Paumen
*Assistant Examiner*—Yong Ki Kim
*Attorney, Agent, or Firm*—Anton P. Ness

[57] ABSTRACT

A receptacle connector (10) including a single plug-receiving cavity (20) adapted for mating with at least two different plug connectors (80,90). A pair of detection contacts separate from the signal contact array include contact sections (66) proximate tabs (34) of a conductive shield (14) and engageable therewith upon deflection of the tabs. Tabs (34) are so positioned as to be deflectable upon mating with one particular plug connector (90), and not deflected upon mating with another particular plug connector (80), generating a signal upon mating with the one connector (90) and not generating a signal upon mating with the other connector (80). Circuitry of a circuit board (24) becomes reconfigured upon receipt of the signal to correspond with transmissions from the one connector (90).

5 Claims, 3 Drawing Sheets

RECEPTACLE CONNECTOR DETECTING MATING WITH DIFFERENT PLUGS

FIELD OF THE INVENTION

This relates to the field of electrical connectors and more particularly to matable plug and receptacle connectors.

BACKGROUND OF THE INVENTION

Especially in telecommunications, there are known two particular widely-used styles of modular plug connectors, identified as RJ11 and RJ45, whose design and dimensions are in keeping with a standard of the "FCC Rules for Registration of Telephone Equipment, Part 68, Subpart F, Connectors". A basic distinction between the two styles of plugs is that the RJ11 plug provides four or six signal contacts at the mating interface, and the RJ45 plug provides eight such contacts, with the width of the plug mating face being adjusted accordingly while maintaining the remainder of the mating face remains similar in configuration and dimensioning. Typically the RJ11 plug is utilized with standard telephonic communication such as a modem, and the RJ45 is utilized with enhanced communication capability such as Ethernet in Local Area Networks (LANs).

Most personal computers are now manufactured with the capability to be connected to modems and to LANs, by providing a receptacle connector in an input/output port of the computer. One approach to providing a single connector capable of mating to either an RJ11 or an RJ45 plug, is for the connector to provide discrete mating interfaces, one for each of the two plug types.

It is desired to provide a connector matable with either the RJ11 or the RJ45 plug while generating an indication as to which plug becomes mated at any particular time.

SUMMARY OF THE INVENTION

The present invention provides a receptacle connector mounted to an electronic apparatus and defining a mating face with a single plug-receiving cavity adapted to mate with either of the different plugs, and includes a detection means or switch automatically responsive in different ways upon mating by each particular plug, the switch being connected to apparatus circuitry that is responsive to the switch.

For mating with two different plugs, one embodiment provides in addition to the ten signal contacts, at least one detection contact. Preferably two such detection contacts are located at respective sides of the mating face within the plug-receiving cavity, each positioned to be engaged during connector mating by a respective tab of a conductive grounded member of the receptacle connector such as a shield upon engagement and deflection by the relatively wide RJ45 plug during mating, while the tabs will not both be deflected into engagement with the respective detection contacts by the relatively narrow RJ11 plug during mating. In response to an indication of mating with an RJ45 wherein both contacts are groundingly engaged with the shield, circuitry of the apparatus within which the receptacle connector is mounted, configures itself to process the transmissions appropriately for a LAN (RJ45 ) connection, while the circuitry is otherwise configured (default) for a modem (RJ11 ) connection.

An embodiment of the invention will now be described by way of example with reference to the accompanying drawings.

DETAILED DESCRIPTION

Figure 1:
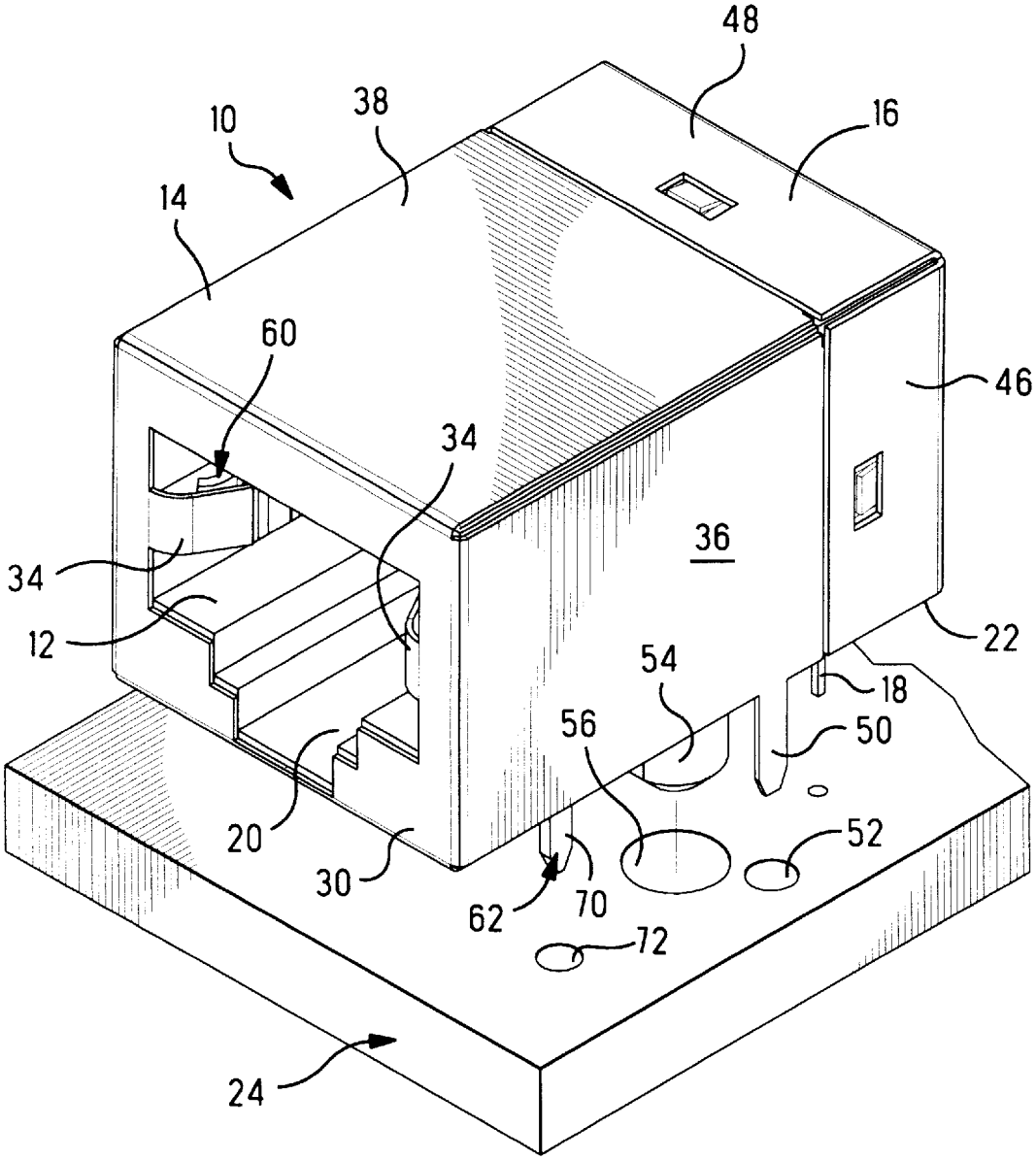
FIG. 1 is an isometric view of the assembled receptacle connector of the invention.
Figure 2:
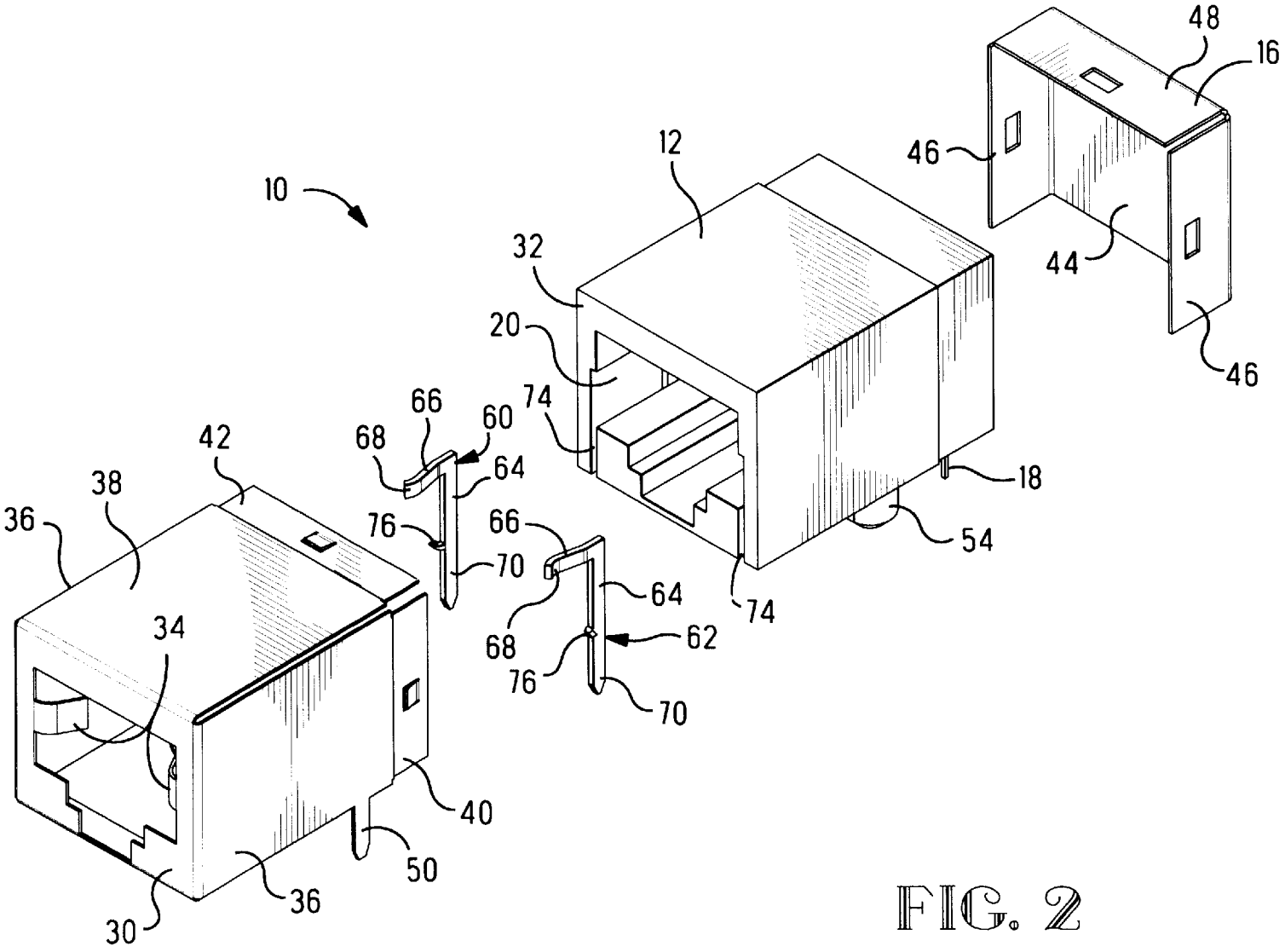
FIG. 2 is an isometric view of the connector of FIG. 1 with the components thereof exploded.

Connector 10 of FIGS. 1 to 4 is a receptacle connector including an insulative housing 12 and an array of signal contacts 18 having contact sections arrayed within the plug-receiving cavity 20 and extending to contact sections arrayed along an additional connection face such as board-mounting face 22 associated with circuit board 24, for communication with an electronic apparatus such as a personal computer within which connector 10 is mounted at an input/output port. In accordance with the invention, connector 10 further includes a conductive member affixed to the insulative housing, and a pair of detection contacts 60,62. The conductive member may be a shield 14 for EMI/RFI protection, and along with rear shield section 16 may surround the housing except along board-mounting face 22 and the entrance to plug-receiving cavity 20.

Shield 14 includes a front wall 30 extending across the front face 32 of housing 12 and including an aperture therethrough corresponding to the plug-receiving cavity, and a pair of plug-engaging tabs 34 extending rearwardly from front wall 30 and angled toward each other partially extending into plug-receiving cavity 20 for engaging side surfaces of a plug connector (FIGS. 3 and 4) during connector mating. Shield 14 further includes side walls 36 and a top wall 38 extending to inwardly recessed rear edge portions 40,42. Rear shield section 16 includes a rear wall 44 forwardly from which extend side portions 46 and top portion 48 that overlap rear edge portions 40,42 and latch therewith defining a shield assembly surrounding top, side and rear walls of housing 12.

Ground contact legs 50 depending from bottom edges of side walls 36 for receipt into through holes 52 of circuit board 24 and connection to ground circuits thereof. Mounting embossments 54 of housing 12 are insertable into mounting holes 56 of board 24.

Figure 3:
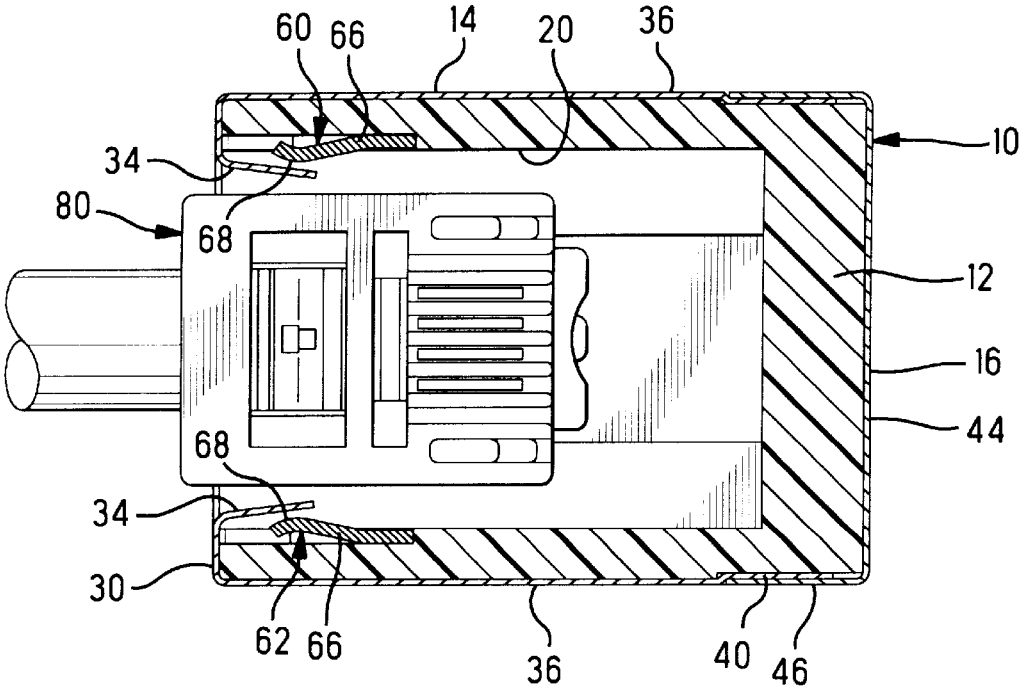
FIG. 3 is a top cross-sectional view of the connector of FIGS. 1 and 2 in mated condition with a first relatively narrower plug with the detection contact unengaged.

Detection contacts 60,62 are disposed in connector 10 and include body sections 64, contact sections 66 that extend forwardly and toward each other as cantilever beams to free ends 68 positioned laterally outwardly of tabs 34 of shield 14 and spaced therefrom when connector 10 is in an unmated state. Contact sections 66 are disposed in portions of plug-receiving cavity that are clearances associated with the greater dimension of a first plug connector 90 (FIG. 4) in a selected direction such as across the width of its mating face, compared with a second plug connector 80 (FIG. 3). Detection contacts 60,62 also include second contact or board-connecting sections 70 that depend beneath connector 10 for connection to circuits of circuit board 24 at through-holes 72, and contacts 60,62 may be insertable into housing 12 by being urged rearwardly along slots 74 in a force fit therein, such as by embossments 76 defined thereon force fit into slots 74, and locating the contacts in a desired position vertically with respect to the connector.

In FIG. 3 a first plug 80 is shown such as an RJ11 plug, that is relatively narrow and does not substantially engage tabs 34 of shield 14 upon being urged into plug-receiving cavity 20 for connector mating with connector 10.

Figure 4:
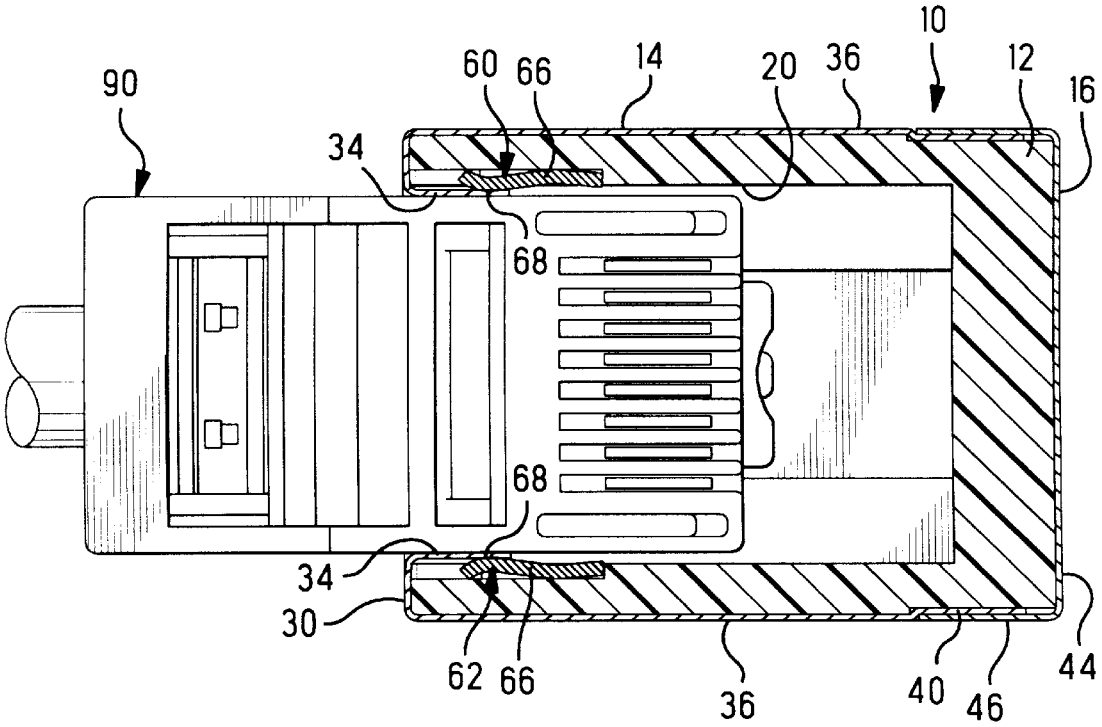
FIG. 4 is a top cross-sectional view of the connector of FIGS. 1 and 2 in mated condition with a second relatively wider plug with the detection contacts engaged signifying mating with a wider plug.

In FIG. 4 is seen a second plug 90 such as an RJ45 plug, that is relatively wide and engages tabs 34 in a manner to deflect tabs 34 outwardly into spring biased engagement with leading ends 68 of contact sections 66 of detection contacts 60,62, thus commoning the detection contacts to shield 14 and to each other, completing a circuit along with associated circuitry of circuit board 24, thus indicating that connector 10 has become mated with a relatively wide plug such as an RJ45 plug. The circuit board circuitry thus senses that the particular plug is an RJ45 plug and configures its circuitry to respond to the signal transmissions for LAN operations for which the RJ45 plug is being utilized Preferably a pair of detection contacts is utilized, so that inadvertent engagement by a tab with one such contact does not generate a false signal were an RJ11 plug to be inserted at an angle sufficient to deflect one of the pair of shield tabs, during early stages of connector mating.

In accordance with the present invention, an additional second contact section is provided connected to circuit board 24; where two detection contacts are utilized, the additional second contact section is defined by the second detection contact; it may be desired to provide only a single detection contact, in which case the conductive member must define the additional second contact section.

Configurations of the board circuitry can be as follows: by designating locations of the signal contacts of connector 10 as 1 to 8, signal contacts at the outermost pin locations 1 and 8 would not be engaged by any contacts when plug 80 is inserted, and the circuitry of the board would have a default configuration not involving any signal or lack of signal from pin locations 1 and 8, and responding to signals from locations 2 to 7 consistent with modem-type communications; and upon activation of the indicator sensing circuitry, the board circuitry would switch to an RJ45 configuration responding to signals or lack of signals from pin locations 1 and 8 since the signal contacts at those locations would be in electrical engagement with corresponding pins of the RJ45 plug, and would also respond to signals and lack of signals from the other locations consistent with LAN communications.

Commonly RJ11 plugs utilize only four contacts in the center four contact positions, but it is desirable for receptacle connector 10 to provide contacts at all eight positions and the circuits of the board be correspondingly configured, to provide for the contingency that six contacts may eventually be used in RJ11 plugs.

Variations and modifications may be devised that are within the spirit of the invention and the scope of the claims.

What is claimed is:

1. A receptacle connector of the type having a plug-receiving cavity for mating with either of first and second plug connectors and having an array of signal contacts exposed in the plug-receiving cavity for engagement with corresponding contacts of the plug connector, where the first plug connector has a larger dimension across the mating face in a selected direction than the second plug connector, the receptacle connector comprising:

an insulative housing containing the signal contacts and defining the plug-receiving cavity, and further including an additional connection face, where said plug-receiving cavity is complementary to both said first and said second plug connectors, a conductive member affixed to said insulative housing isolated from signal contacts, and at least one detection contact mounted to the housing at least adjacent the plug-receiving cavity and having a contact section exposed within the plug-receiving cavity and disposed in a clearance associated with said larger dimension of said first plug connector, and cooperable with a respective tab of said conductive member disposed within the plug-receiving cavity, and further having a second contact section exposed at said additional connection face, and an additional second contact section exposed at said additional connection face and defined on either said conductive member or a second said detection contact, each said tab being positioned proximate a said clearance such that said tab is engageable by said first plug connector at said larger dimension thereof when said plug connector is insertable into the plug-receiving cavity, such that said tab is deflectable into engagement with a contact section of said detection contact, and such that said tab is not deflectable by said second plug connector into engagement with said contact section upon insertion of said second plug connector into the plug-receiving cavity, whereby each detection contact becomes commoned with said conductive member upon insertion of said first plug connector, generating a signal detectable by the electronic apparatus to which the receptacle connector is connected through said second contact section and said additional second contact section at said additional connection face to configure circuitry to correspond with transmissions through said first plug connector.

2. The receptacle connector as set forth in claim 1 wherein said housing includes a pair of said detection contacts associated with corresponding said tabs of said conductive member.

3. The receptacle connector as set forth in claim 1 wherein said conductive member is a shield at least having a front wall extending across the mating face and apertured to permit plug connector insertion into the plug-receiving cavity, and each said tab extends rearwardly from said front wall and into the plug-receiving cavity.

4. A receptacle connector of the type having a plug-receiving cavity for mating with either of first and second plug connectors and having an array of signal contacts exposed in the plug-receiving cavity for engagement with corresponding contacts of the plug connector, comprising:

an insulative housing containing the signal contacts and defining the plug-receiving cavity, and further including an additional connection face, a conductive member affixed to said insulative housing isolated from signal contacts, and at least one detection contact mounted to the housing at least adjacent the plug-receiving cavity and having a contact section exposed within the plug-receiving cavity and cooperable with a respective tab of said conductive member disposed within the plug-receiving cavity, and further having a second contact section exposed at said additional connection face, and an additional second contact section exposed at said additional connection face and defined on either said conductive member or a second said detection contact, each said tab being positioned at a selected location such that said tab is engageable by said first plug connector insertable into the plug-receiving cavity and deflectable into engagement with a contact section of said detection contact, and such that said tab is not deflectable by said second plug connector into engagement with said contact section upon insertion of said second plug connector into the plug-receiving cavity, and said conductive member is a shield at least having a front wall extending across the mating face and apertured to permit plug connector insertion into the plug-receiving cavity, and each said tab extends rearwardly from said front wall and into the plug-receiving cavity, whereby each detection contact becomes commoned with said conductive member upon insertion of said first plug connector, generating a signal detectable by the electronic apparatus to which the receptacle connector is connected through said second contact section and said additional second contact section at said additional connection face to configure circuitry to correspond with transmissions through said first plug connector.

5. The receptacle connector as set forth in claim 4 wherein said housing includes a pair of said detection contacts associated with corresponding said tabs of said conductive member.

* * * * *